United States Patent [19]

Okazaki et al.

[11] Patent Number: 4,839,627

[45] Date of Patent: Jun. 13, 1989

[54] VARIABLE RESISTOR

[75] Inventors: Atsushi Okazaki, Iruma; Masahiko Igarashi, Mitaka; Tsuneo Horie, Iruma, all of Japan

[73] Assignee: Copal Electronics Co., Ltd., Tokyo, Japan

[21] Appl. No.: 140,239

[22] Filed: Dec. 31, 1987

Related U.S. Application Data

[63] Continuation of Ser. No. 841,459, Mar. 19, 1985, abandoned.

[30] Foreign Application Priority Data

Mar. 22, 1985 [JP] Japan ..... 60-57865
Mar. 22, 1985 [JP] Japan ..... 60-57866
Mar. 22, 1985 [JP] Japan ..... 60-57867

[51] Int. Cl.[4] ..... H01C 10/34

[52] U.S. Cl. ..... 338/174; 338/184; 29/610.1

[58] Field of Search ..... 338/174, 175, 176, 184; 29/610 R

[56] References Cited

U.S. PATENT DOCUMENTS 3,381,081 4/1968 Schalliol ..... 174/68.5
4,219,796 8/1980 Nishizawa ..... 338/174 X
4,433,322 2/1984 Hirayama et al. ..... 338/162

*Primary Examiner*—Elliot A. Goldberg
*Assistant Examiner*—Marvin M. Lateef
*Attorney, Agent, or Firm*—Wenderoth, Lind & Ponack

[57] ABSTRACT

A variable resistor including terminal leads punched out of a metal plate the end portions of which are arranged to be positioned accurately onto corresponding collector or conductor elements disposed on a base respectively by setting the metal plate at a fixed position, filler elements filling a gap extending between the collector element and the conductor elements and a gap extending between the conductor elements and which prevent an outflow of synthetic resin into the center of a housing during the process of molding the housing and a parallel gap electrode provided with a pair of parallel electrodes which are provided on an unplated surface of the end portions of the lead terminals during the process of welding the terminal leads onto the corresponding collector and the conductive elements respectively.

3 Claims, 5 Drawing Sheets

VARIABLE RESISTOR

BACKGROUND OF THE INVENTION

The present application is a continuation of U.S. Application Serial No. 841,459 filed Mar. 19, 1985, now abandoned.

This invention relates to a varible resistor and more particularly to a structure of a terminal lead and a process of forming a housing thereof by insert molding.

In some prior art, whenever terminal leads of a variable resistor are assembled to conductive elements or a collector element arranged on a base respectively, each terminal lead is inserted one by one from below a base into a hole disposed in the base and is connected with a corresponding element by use of a conductive adhesive and then by the use of an additional insulative adhesive and a pocket disposed at the bottom of the base is filled so that the terminal leads are firmly fastened to the base. The structure of the prior art is so complicated that it can not meet the requirements for mass production of miniature variable resistors.

In some prior art, a sheet metal plate is punched to form three terminal leads extending parallel to one another from one side of the plate. Since the arrangement of the terminals is on a one-side-support structure, accurate positioning of the terminal leads onto a corresponding element such as conductors or a collector disposed on the base requires some skill when welding is performed between the terminal leads and the corresponding elements.

SUMMARY OF THE INVENTION

It is an object of this invention to provide a simple and well balanced structure of terminal leads which may be accurately positioned onto any corresponding element to be welded thereto and disposed on the base of a variable resistor when welding of the former to the latter is performed.

Punched out terminal leads are usually solder-plated on both the upperside and underside thereof by means of a solder welding device before being welded to any corresponding element disposed on the base of a variable resistor. When a welding rod is applied on the solderplated surface of the terminal lead during the process of welding, the welding rod is often contaminated with molten flux of the solder flowing over the plated surface of the terminal lead. Therefore in order to improve welding efficiency, the flux should be removed or a frequent replacement of the contaminated welding rod is required.

It is another object of this invention to provide a method of welding which prevents undesired molten flux from contaminating a welding rod.

After the terminal leads are welded to corresponding elements such as a collector element or conductor elements disposed on the base of the variable resistor, a housing is produced by means of molding a synthetic resin such as thermoplastic. While molding the housing, an excessive fluidization and outflows of synthetic resin tends to flow into the housing center thus formed resulting in contamination on the collector element, conductor elements or a resistance track whereby a desired contact resistance variation of the variable resistor may not be obtained.

It is still another object of this invention to provide filling elements to prevent an outflow of synthetic resin into the housing during the process of molding the housing.

BRIEF DESCRIPTION OF THE DRAWINGS

The present invention, however, together with further objects and advantages thereof, may best be understood by reference to the following description taken in conjunction with the accompanying drawings in which.

DETAILED DESCRIPTION OF THE PREFERRED EMBODIMENT

The invention will now be described in detail, making reference to the accompanying drawings.

Figure 1:
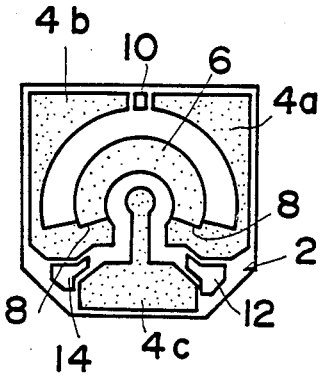
FIG. 1 is a plan view of a base on which a resistance track, conductive elements and a collector element are disposed.

FIG. 1 is a plan view showing the structure of a base 2 which is preferably comprised of ceramic and on which a conductor element 4a, 4b and a collector element 4c are printed and baked while an arcuate resistance track 6 is also printed and baked thereon. The resistance track 6 overlaps conductor elements 4a and 4b, respectively, at positions represented by reference numerals 8. A rectangular filling element 10 preferably comprised of glass is printed and baked on the base 2 at a location between conductor elements **4*a* and 4*b* while one set of filling elements 12 and 14 preferably comprised of glass are also printed and baked on the base 2 at locations between the collector element 4*c* and the conductor elements 4a and 4b**, respectively.

Figure 5:
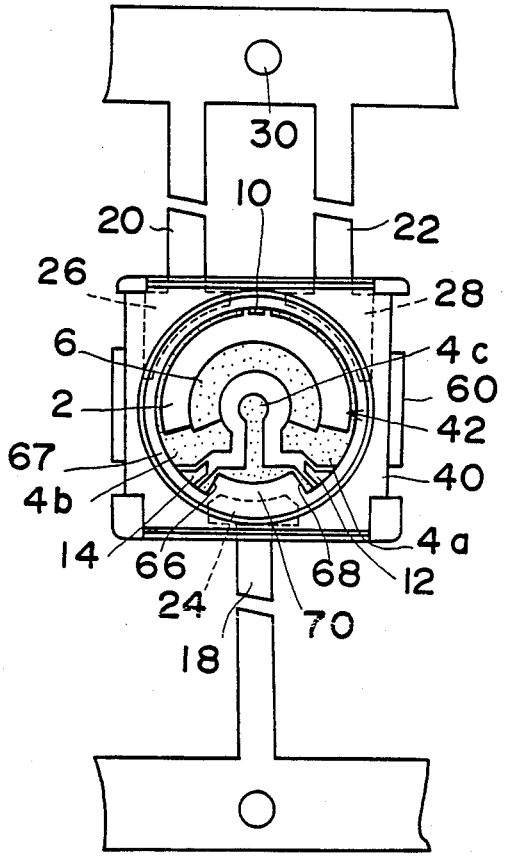
FIG. 5 is a plan view of a molded housing of the variable resistor with a rotor taken away.
Figure 6:
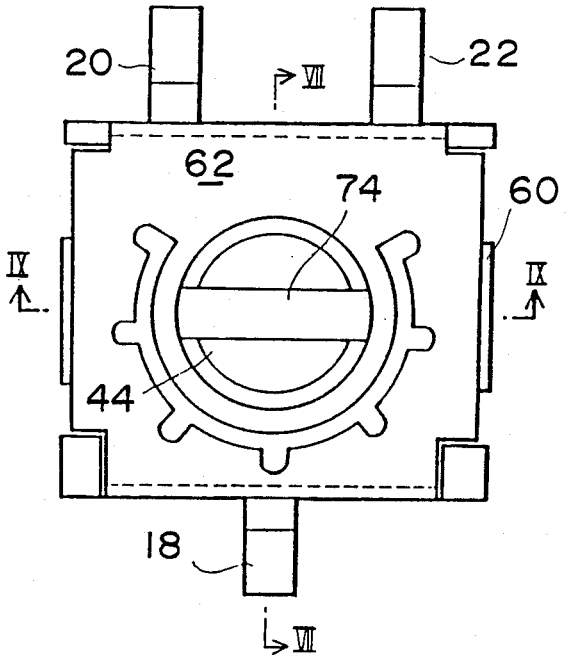
FIG. 6 is a plan view of a variable resistor of the present invention.
Figure 7:
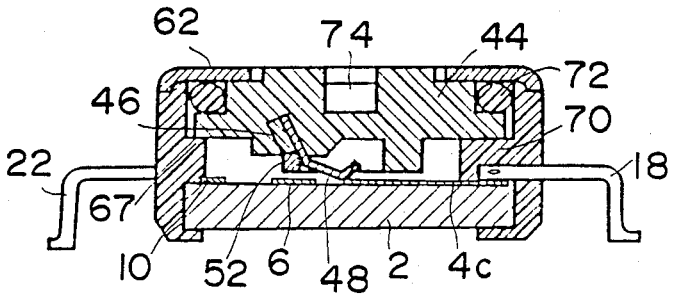
FIG. 7 is a sectional view taken along line VII—VII of FIG. 6.

The filling elements prevent an excess fluidization and an out-flow of synethetic resin into the center of housing 40 and the base 2 of a variable resistor during the molding process used in manufacturing the housing 40 from synthetic resin (FIG. 5).

Figure 2:
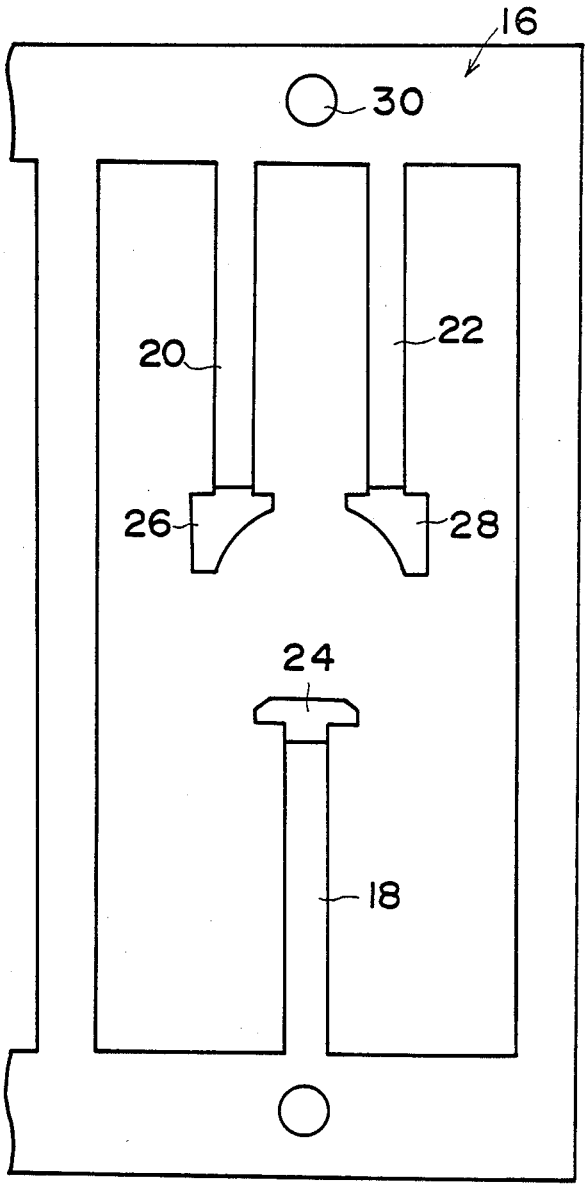
FIG. 2 is a plan view of a metal plate provided with punched-out terminal leads.
Figure 3:
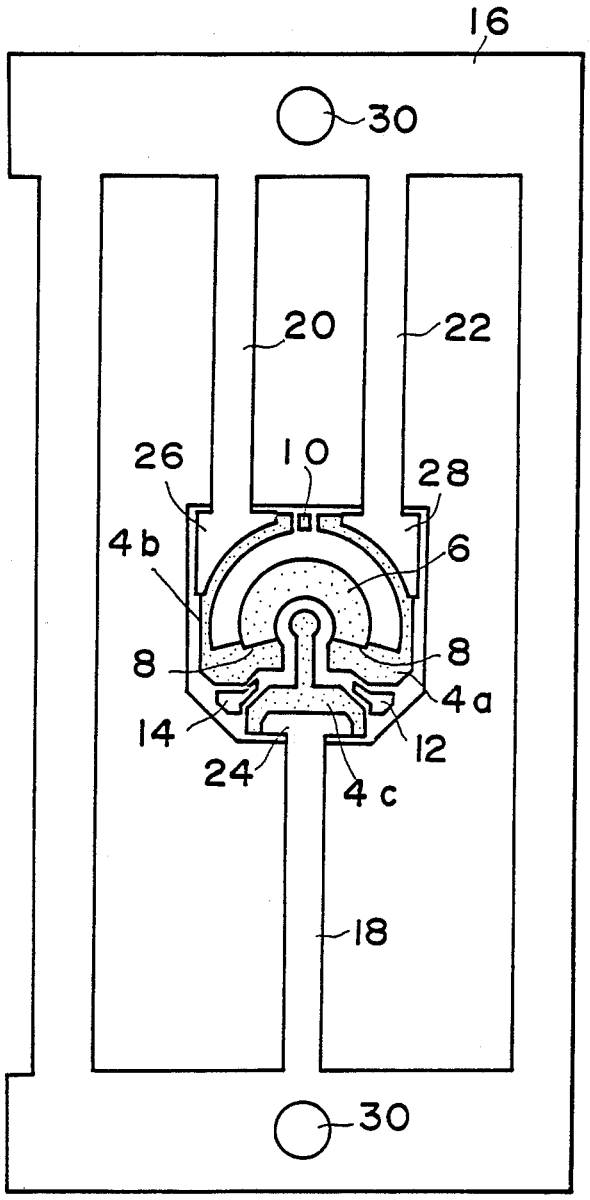
FIG. 3 is a plan view of terminal leads welded onto a corresponding element disposed on the base.

Terminal leads 18, 20 and 22 are, as shown in FIG. 2, punched out of a piece of a metal plate 16 which is preferably comprised of phosphor bronze. The two terminal leads 20 and 22 arranged in parallel extend from one side of the metal plate 16 while the other terminal lead 18 extends from the opposite side thereof. End portions 26 and 28 of the terminal leads 20 and 22 respectively face an end portion of the terminal lead 18 and thus, these three end portions 26, 28 and 24 are arranged in the shape of a triangle.

Figure 4A:
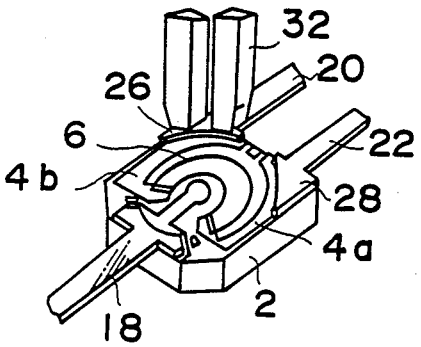
FIG. 4 (*a*) is a perspective view of an electrode, while FIG. 4 (*b*) is a front view of the electrode shown in FIG. 4 (*a*)
Figure 4B:
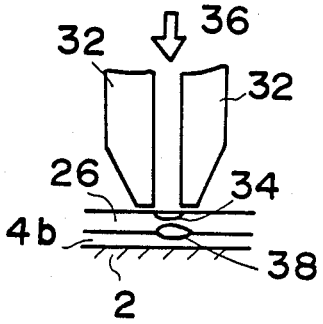

The method of connecting the terminal leads 18, 20 and 22 to conductor elements 4a and 4b and a collector element 4c which are arranged on the base 2 will be now explained with reference to FIG. 4. A pair of electrodes 32 of an electric welder (not shown) which are arranged in parallel with a gap extending therebetween (hereinafter referred to as a "parallel gap electrode rod") are applied to an unplated surface of an end portion 26 of terminal lead 20 which is in turn placed on the corner of conductive element 4*b*.

Whenever an electric current 34 flows through a parallel gap electrode 32 which is also pushed onto the end portion 26 by pressure acting in the direction of arrow 36, a welding agent 38 is melted by heat created by the electric current whereby the end portion 26 is welded to the conductor element 4*b*. Similarly, the terminal leads 22 and 18 are welded to the conductor element 4*a* and the collector element 4*c*, respectively. The upper surface of edge portions 24, 26 and 28 of terminal leads on which a parallel gap electrode 32 of the welding device contacts are comprised of phosphor bronze which are not solder-plated, as heretofore explained.

As long as the parallel gap electrode 32 is applied to the end portions 24, 26 and 28 which are not solder-plated, as explained heretofore, and even when the welding agent 38 is melted by means of heat thus created, the molten flux of the welding magnet 38 does not flow out over the unplated surface of end portions 24, 26 and 28 which are comprised of phosphor bronze. Thus, efficient welding between the end portions of the terminal leads and the conductor and collector elements may be performed without contaminating the electrode 32.

The end portions 24, 26 and 28 of terminal leads 18, 20 and 22 are arranged as shown in FIG. 2, so that they are accurately positioned onto their corresponding assemble elements 4*c*, 4*b* and 4*a* as soon as the metal plate 16 is fixed on a welding stand (not shown) by means of holes 30 disposed in the metal plate 16, in the preparation of welding.

FIG. 5 is a plan view of a housing 40 manufactured by molding synthetic resin. A rotor 44 provided with a wiper 48 therein is rotatably received in a holder 42 of the housing 40. The housing 40 may accommodate the base 2 to which end portions 26, 28 and 24 of terminal leads 20, 22 and 18 are thus welded, respectively, via the collector element 46 and the conductor elements 4*b* and 4*a* respectively, together with the rotor 44. The case 62 is assembled to the housing 40 with projections 60 thereof being slidably snapped into holder 64 of a pair of bended legs 63 of case 62 when the former is pushed down upon the housing 40. An O-ring 72 is located in a recess of the rotor 44. And finally, an individual one of the terminal lead 18, 20 and 22 is formed by cutting an end thereof so as to have a predetermined length.

Figure 8:
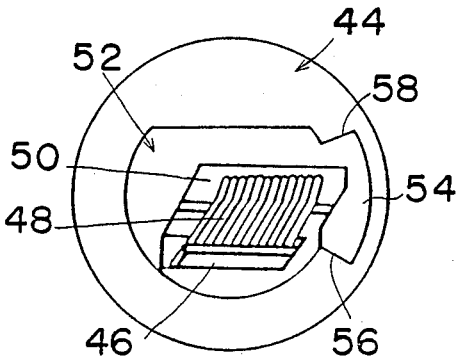
FIG. 8 is a plan view of a rotor to which a wiper is connected.
Figure 9:
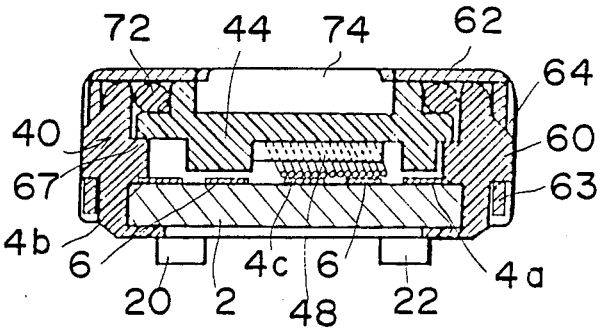
FIG. 9 is a section view of FIG. 6 taken along line IX—IX.

In FIG. 8, a slanted groove 50 extends in the rotor 44 and accommodates a brush wiper 48 which has wires slantedly arranged and is held by a support plate 46. A projecting ridge 52 is arranged around the groove 50 and an arcuate portion 54 of the ridge 52 is provided with vertical walls 56 and 58.

An annular wall 67 is arranged at an inner side of the hold 42 of the housing 40. The wall supports the rotor 44 rotatably received in the housing 40. A wide wall 70 which is an extension of the annular wall 67 is provided with side walls 66 and 68 adjacent to the collector element 4*c*.

Whenever the rotor 44 is rotated over a predetermined angle, either clockwise or counterclockwise by applying a screw driver or the like to a slit 74 formed in a top of the rotor 44, the brush wiper 48 slidingly contacts the resistance track 6 and the collector element 4*c*, and thus a desired contact resistance variation may be obtained.

The rotation of the rotor 44 is stopped when the walls 56 or 58 of the arcuate portion 54 of the rotor ridge 52 abut against either side of the side wall 66 or 68 of the wide wall 70 adjacent the collector element 4*c*.

The advantages of the present invention will be summarized as follows:

1. The arrangement of terminal leads punched out from a piece of metal plate enables an accurate positioning of end portions thereof onto the corresponding collector or conductor element, and thus the efficiency of welding may be improved.

2. The filling elements filling gaps between the collector element and the conductor element prevent the outflow of synthetic resin into the housing center during the process of molding the housing.

3. The unplated surfaces of the end portions of the terminal leads prevent the parallel gap electrode rod from producing the undesired molten flux during the process of welding the terminal leads to the corresponding collector or conductor elements and thus extra work such as the removal of flux or frequent replacement of an electrode rod is obviated.

What we claim is:

1. A variable resistor comprising:

a housing;

a base disposed in said housing and between which a cavity is defined;

said base having disposed thereon a resistance track, spaced apart conductor elements operatively electrically connected to the resistance track, a collector element spaced from said conductor elements, and a respective filler element extending across each space between the conductor elements and the space between the collector element and the conductor elements, a rotor having a wiper connected thereto within said cavity, the wiper in operative electrical contact with said resistance track and said collector element;

a plurality of terminal leads each having a respective end portion which is welded to a respective one of said conductor elements and said collector element, said terminal leads plated with solder except on respective outwardly facing upper surfaces of said respective end portions thereof at which upper surfaces the terminal leads are respectively welded to said conductor elements and said collector element.

2. A method of manufacturing a variable resistor, said method comprising:

securing a resistance track and a pair of collector elements to a base member;

forming three metal integrally connected terminal leads with two of the leads extending parallel to one another and with free end portions of the leads disposed in a triangular configuration in which said end portions define the vertices of a triangle;

plating the terminal leads with solder except on respective upper surface of said free end portions;

placing the free end portions disposed in said triangular configuration on the base member with each of the free end portions of the terminal leads contacting a respective one of said conductor elements and said collector element and with said upper surfaces of the free end portions facing outwardly;

welding each of the terminal leads at the free end portions thereof to the respective one of said conductor elements and said collector element on which the free end portions are placed;

molding a housing to the base with a rotor having a wiper being disposed within the housing and the base, the wiper being placed in operative electrical contact with said resistance track and said collector element;

and severing the integrally connected terminal leads from one another.

3. A method of manufacturing a variable resistor comprising a housing comprised of a synthetic resin, a base in said housing and on which conductor elements operatively electrically connected to a resistance track and a collector element are fixed, each of the conductor elements and the collector element being spaced apart from one another on said base such that respective gaps are defined therebetween, and a plurality of terminal leads having end portions thereof the fixed to a respective one of the conductor elements and each collector element, said method comprising:

molding the housing to the base; and prior to the molding of the housing to the base, mounting a respective filling element onto the base in each of the gaps defined between said conductor elements and each of the conductor elements and the collector element for preventing an outflow of the synthetic resin into the housing during the molding of the housing to the base.

* * * * *